United States Patent [19]

Martin

[11] Patent Number: 4,904,331

[45] Date of Patent: Feb. 27, 1990

[54] APPARATUS FOR THE MANUFACTURE OF PILE FABRICS

[75] Inventor: Stephen C. Martin, Upper Hutt, New Zealand

[73] Assignee: George-Martin Textiles Limited, Napier, New Zealand

[21] Appl. No.: 108,669

[22] Filed: Oct. 15, 1987

[30] Foreign Application Priority Data

Oct. 17, 1986 [NZ] New Zealand ..... 217982

[51] Int. Cl.[4] ..... B32B 5/00

[52] U.S. Cl. ..... 156/435; 156/72; 156/173; 156/174; 156/426; 156/427; 156/512

[58] Field of Search ..... 156/72, 174, 173, 425, 156/426, 429, 427, 512, 435; 428/92, 93; 300/21

[56] References Cited

U.S. PATENT DOCUMENTS

| | | | |
|---|---|---|---|
| 1,854,193 | 4/1932 | Hopkinson | 156/173 |
| 2,242,444 | 5/1941 | Altenbern et al. | 300/21 |
| 2,344,537 | 3/1944 | Cone | 428/93 |
| 2,475,019 | 7/1949 | Faris | 156/173 |
| 2,592,201 | 4/1952 | Shaw | 156/173 |
| 2,786,508 | 3/1957 | Waage | 156/173 |
| 3,689,117 | 9/1972 | Hules | 300/21 |
| 3,884,130 | 5/1975 | Stolkin et al. | 493/131 X |
| 3,947,306 | 3/1976 | Haemer | 156/72 |
| 4,015,036 | 3/1977 | Haemer | 156/72 X |
| 4,367,117 | 1/1983 | Seaborn | 156/443 |
| 4,636,185 | 1/1987 | Carter et al. | 493/151 X |
| 4,676,860 | 6/1987 | Lee et al. | 156/227 X |

FOREIGN PATENT DOCUMENTS

| | | | |
|---|---|---|---|
| 0518153 | 3/1955 | Italy | 156/435 |

*Primary Examiner*—David Simmons
*Assistant Examiner*—Jeff H. Aftergut
*Attorney, Agent, or Firm*—Nixon & Vanderhye

[57] ABSTRACT

The invention provides apparatus for manufacturing pile fabrics, a method of using the apparatus and pile fabrics produced by the method. The apparatus is particularly suitable for use in the production of pile fabrics incorporating natural woollen fibers by adhesion of a series of courses of wool fiber to a backing sheet of appropriate material.

31 Claims, 5 Drawing Sheets

APPARATUS FOR THE MANUFACTURE OF PILE FABRICS

FIELD OF THE INVENTION

This invention relates to improvements in methods and apparatus for manufacturing pile fabric. More particularly, it relates to a method of manufacturing pile fabric in which woolen sliver can be utilized to apparatus for performing the method and to pile fabric made by the method.

BACKGROUND OF THE INVENTION

There has been a recent interest in both pile fabrics generally and in a pile fabric utilizing the characteristics of natural woolen sliver in particular. There are many methods available to produce pile fabrics but these are generally expensive and will not operate reliably with a sliver of corded wool.

The prior art methods known to the applicants which involve the utilization of natural woolen sliver include the steps of manually winding woolen sliver about a plurality of formers, applying adhesive to the wound sliver and adhering the sliver to a backing sheet before cutting it free from the formers. However, these known methods involve disadvantages.

Specifically, with these known methods difficulties are experienced in terms of monitoring the amount of adhesive required to achieve the bonding between the sliver and the backing sheet. An excess of adhesive used has the disadvantages of increasing both the expense of the process and the handle of the finished product whereas the use of insufficient adhesive results in a poor bonding. Further disadvantages of these methods reside in their being labor intensive and time consuming thus again increasing the cost of producing the product.

It is therefore an object of the present invention to provide a method and apparatus for manufacturing a pile fabric which will go some distance towards overcoming the aforementioned difficulties or to at least provide the public with a useful choice.

SUMMARY OF THE INVENTION

Accordingly, in one aspect the invention may broadly be said to consist in apparatus for producing pile fabric comprising:

a frame;

feed means for a continuous length of pile fibre;

a course former rotatably mounted within said frame and about which pile fibre from said pile fibre feed means can be wound;

drive means to rotate said course former;

an adhesive applicator capable of applying adhesive to said pile fibre when wound about said course former;

backing sheet feed means; and means to cut said pile fibre wound about said course former free from said former;

the apparatus being such that in use a length of pile fibre from said pile fibre feed means is wound about said course former and has adhesive applied thereto before being contacted with a backing sheet from said backing sheet feed means, the wound pile fibre then being cut free of the course former by the cutting means to leave a course of pile fibre adhesively bonded to the backing sheet.

In a further aspect, the invention can be said to consist in a method of manufacturing a pile fabric comprising the steps of;

providing apparatus for producing pile fabric as defined above;

engaging a continuous length of pile fibre with the pile fibre feed means of said apparatus;

causing said pile fibre feed means to engage the free end of the pile fibre with the course former of the apparatus;

rotating said course former to wind the pile fibre along the length thereof;

applying an adhesive to the pile fibre wound about the former along one surface of the former;

contacting a backing sheet with the wound pile fibre to which the adhesive has been applied;

cutting the wound pile fibre free of the course former to leave a course of fibre adhered to the backing sheet; and re-engaging the free end of said continuous length of pile fibre with said course former such that upon further rotation of the course former the pile fibre is again wound onto the former to commence the formation of the next course.

In still a further aspect, the invention consists of a pile fabric produced in accordance with the method of the invention.

BRIEF DESCRIPTION OF THE DRAWINGS

Although the invention is broadly as defined above, it will be appreciated by those persons skilled in the art that the invention is not limited thereto and that it also includes embodiments of which the following description gives examples. In particular, certain preferred aspects of the invention will be more clearly understood by having reference to the accompanying drawings wherein.

DETAILED DESCRIPTION OF THE INVENTION

In one embodiment, the invention relates to apparatus for producing a pile fabric. Although the apparatus is particularly suitable for use in manufacturing woolen pile fabrics, it will be appreciated that it is not limited to such applications and that other pile fibres, both natural and synthetic, can be utilized.

A preferred form of the pile fabric producing apparatus according to one embodiment of the invention is shown in the accompanying drawings.

Figure 1:
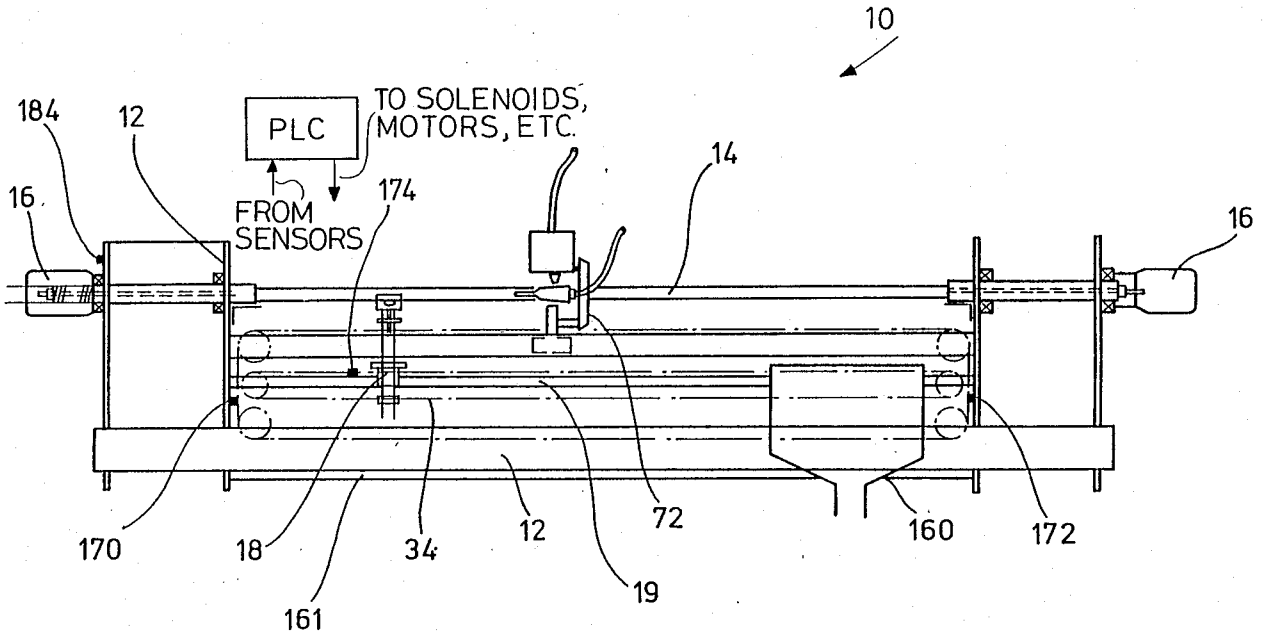
FIG. 1 is a front elevational view of aspects the apparatus according to one embodiment of the invention.

With reference to FIG. 1, the apparatus designated generally as 10 is constructed located in a suitable frame 12. A course former 14 is rotatably mounted within frame 12. As illustrated course former 14 is preferably a metal batten of substantially rectangular shape, the width of one pair of opposed surfaces being approximately 40 mm and the width of the other pair of opposed surfaces being approximately 12 mm although these dimensions are in no way critical. In use, the narrower pair of surfaces comprises respectively the adhesive contact surface and the cutting surface, whereas the width of the other pair of surfaces substantially corresponds to the length of pile fibre to be applied to the backing sheet as is described hereinafter.

In particularly preferred embodiments of the invention, the adhesive contact surface of the course former 14 incorporates a heated platen to aid in the curing of the adhesive while the cutting surface is provided with a groove along the length thereof to facilitate the cutting of the pile fibre.

The course former is mounted in the frame so that it may be rotated by any appropriate drive means, for example, an electric motor. As is shown in the drawings, the presently preferred drive means is an electric motor 16 having a stepping characteristic such as a Slo-Syn stepper motor. It is further preferred that there be a stepping motor 16 at each end of the course former 14 to reduce any undesirable torsional forces in the course former 14 during operation.

The apparatus of the invention is further provided with pile fibre feed means. The pile fibre feed means is designed to engage the free end of a continuous length of pile fibre with the course former and to guide the pile fibre as it is being wound along the length of the course former.

Conveniently, the pile fibre feed means includes means capable of at least partially encircling the course former to engage the free end of the continuous length of pile fibre with the course former. It is further preferred that the encircling means be movable from a first position at least partially encircling the course former to a second position spaced apart from and below the course former once the winding of the pile fibre about the former has commenced.

Figure 2:
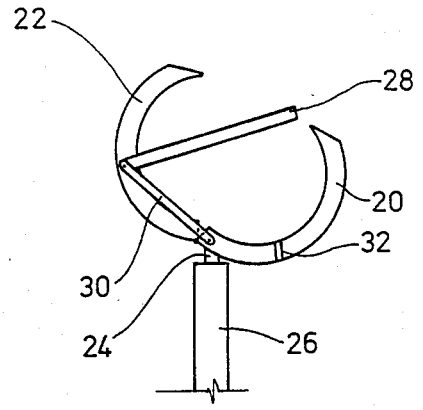
FIG. 2 is a front elevational view of the pile fibre feed means of one embodiment of the invention.

The presently preferred construction for the pile fibre feed means is shown in the accompanying drawings and in particular in FIG. 2. As illustrated, pile fibre feed means 18 comprises a pair of concave jaw members 20 and 22 mounted on the T-section of a piston rod 24 of a cylinder 26. As shown, jaw 22 is hinged so as to be pivotally movable towards and away from engagement with jaw 20. Jaw 22 is further provided with an arm 28 and pivotal linkage 30, the function of which is described below.

As can be seen from FIG. 2, jaw 20 is further provided with an opening or slot 32 through which a continuous length of pile fibre can pass. The opening 32 is preferably sufficiently large to allow the length of pile fibre to easily pass therethrough but is also small enough to retain the free end of the pile fibre in engagement with jaw 20 when the pile fibre is cut during formation of the pile fabric.

As shown in FIG. 2, the pile fibre feed means 18 is in a rest position with jaw 22 positioned away from engagement with jaw 20. Upon actuation of cylinder 26, piston rod 24 moves jaws 20 and 22 upwardly until jaw 20 is positioned immediately below and partially encircling the course former 14. At this time, arm 28 contacts the course former 14 and is deflected downwardly causing the pivotal linkage 30 to move jaw 22 from its rest position into engagement with jaw 20 to complete the encirclement of the course former 14. Of course, the size and shape of the jaws 20 and 22 is such that course former 14 can rotate freely when encircled by the jaws. In this way, the continuous length of pile fibre is brought into and retained in contact with course former 14. Accordingly, upon rotation of course former 14 by stepper motors 16, the length of pile fibre is caused to engage with course former 14 to be wound thereabout.

This encirclement preferably lasts for as long as it takes the course former 14 to complete 1.5 revolutions.

After the completion of 1.5 revolutions the piston rod 24 moves downwards, causing jaw 22 to be deflected away from its engagement with jaw 20 towards its rest position. If desired, biassing means such as a spring may also be included to aid the movement of jaw 22 towards its rest position.

Once the feed means 18 has reached its rest position, it is then caused by an appropriate longitudinal drive means to move along a track 19 which is below and substantially parallel to the course former 14 to allow pile fibre to be fed from the feed means 18 to the course former over the whole length of the course former. As is shown in the drawings, an endless chain drive 34 can be used.

The apparatus of the invention is further provided with an adhesive applicator which is capable of applying adhesive to the pile fibre when it is wound about the course former. The adhesive applicator is conveniently mounted to a carriage which is engageable with a longitudinal drive to move the applicator over the length of the course former about which the fibre is to be wound. Once again an appropriate longitudinal drive such as a chain drive may be used although this is not critical.

The preferred adhesive applicator includes a constant displacement pump which is connectable to a nozzle to apply the adhesive to the pile fibre when it is wound about the course former. The construction of the preferred adhesive applicator when mounted to a carriage is shown in the accompanying drawings and in FIGS. 3A and 3B in particular.

Figure 3A:
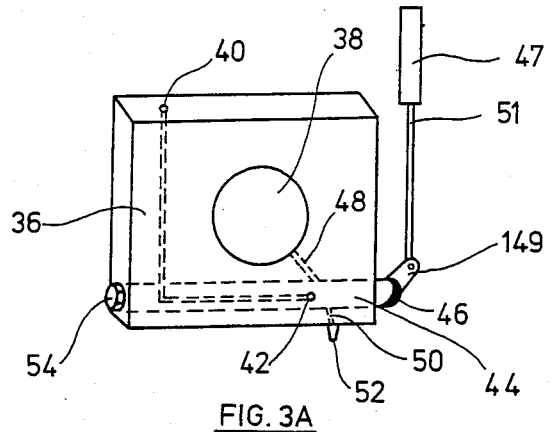
FIG. 3A is a perspective view of the reservoir of the constant displacement pump of the preferred apparatus of the invention.

As is shown in FIG. 3A, the constant displacement pump includes s body 36 which is preferably formed of a plastics material which incorporates an adhesive reservoir 38. As can be seen from FIG. 3A the adhesive reservoir 38 is open to the exterior of body 36.

Body 36 is also provided with an adhesive inlet 40 through which adhesive, preferably a latex adhesive, can be supplied to internal passages within the body 36 shown in outline. These internal passages carry the adhesive from the inlet 40 to an opening 42 which communicates with a bore 44 passing through body 36 beneath the reservoir 38. Within bore 44 there is provided a valve 46 which receives the adhesive passing through opening 42 and which passes the adhesive through channel 48 and into reservoir 38 of the body. Valve 46 is also capable of receiving the adhesive from reservoir 38 and passing the adhesive either back to the adhesive inlet 40 through opening 42 or through a channel 50 which is in communication with nozzle 52. Nozzle 52 is preferably formed of teflon.

The direction of flow of adhesive throughout the body 36 is controlled by the relative rotation of the valve 46 into preset positions. This relative rotation is in turn controlled by the use of mechanical means in the form of a pneumatic ram 47 with associated linkages 49 and 51 which engage with the end of valve 46 projecting from bore 44.

As is also shown in FIG. 3A, the body 36 optionally includes holding means such as nut 54 which holds the valve 46 within bore 44.

Figure 3B:
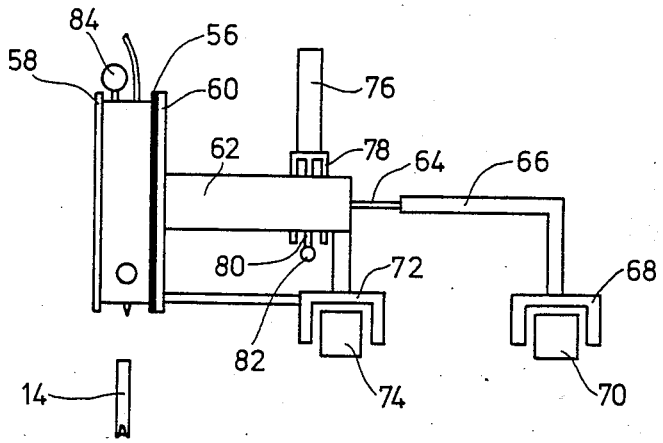
FIG. 3B is a side elevational view of the preferred adhesive applicator of the invention including the reservoir of FIG. 3A.

The body of FIG. 3A is incorporated into the adhesive applicator shown in FIG. 3B. In the construction shown, a diaphragm 56 is positioned to cover the opening of the reservoir 38 in the body and is resiliently movable to vary the volume of the reservoir. The body 36 and diaphragm 56 are then positioned between two metal plates 58 and 60 which are secured together. In particular, the positioning of plates 60 over diaphragm 56 is such that an airtight area is formed between the area of the diaphragm 56 covering the opening to the reservoir 38 and the plate 60.

To the opposite side of plate 60 to that engaging the diaphragm 56, there is secured a cylinder capable of housing means capable of displacing the diaphragm inwardly to reduce the volume of the reservoir 38. Preferably, the cylinder is a piston cylinder 62 of an hydraulic piston, the piston rod 64 of which is in hydraulic communication with the diaphragm 56 through an opening in plate 60 (not shown).

To the distal end of piston rod 64 there is attached a linkage 66 which is engaged with a slide 68 which is slidably movable along a track 70. Track 70 is preferably mounted to the frame 12 of the apparatus at an angle such that movement of the slide 68 along the track 70 from one end of the track to the other causes the piston rod 64 to be displaced inwardly into cylinder 62 to in turn cause the diaphragm 56 to be displaced inwardly into reservoir 38 of the body. The adhesive within the reservoir 38 is thus displaced out through nozzle 52 or back towards the adhesive supply.

The constant displacement pump described above is preferably mounted to a carriage 72 which is itself slidably movable along a track 74. Track 74 is however, substantially parallel to course former 14 of the apparatus. To drive the carriage 72 along track 74, the carriage further includes means for engaging a drive in the form of a ram 76 mounted to housing 78. The piston rod 80 of ram 76 extends downwardly through the housing 78 to engage with a longitudinal drive in the form of a chain 82.

The apparatus of the invention further includes cutting means to cut the pile fibre wound about the course former free from the former once it has been adhered to the backing sheet. In the presently preferred embodiment, the cutting means is also mounted to the carriage to which the adhesive applicator is mounted. In this preferred embodiment, the carriage includes means capable of pivoting the cutting means from a first position out of engagement with the course former to a second position in engagement with the course former so that in this second position the cutting means can cut the pile fibre wound around the former free.

Figure 4:
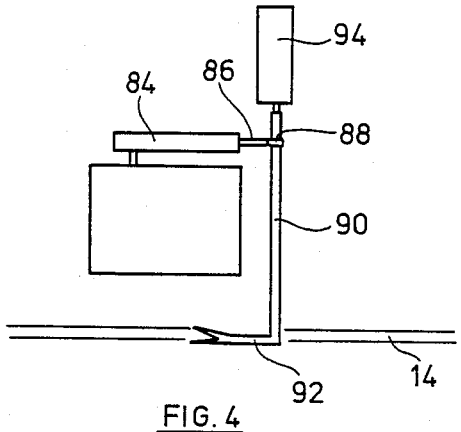
FIG. 4 is a diagrammatic representation of the construction of the preferred cutting means of the invention.

The construction of this preferred embodiment is shown in FIG. 4 of the accompanying drawings. As shown, a ram 84 is mounted to the top of the adhesive applicator, the piston rod 86 of the ram pivotally engaging with a linkage 88 which is in turn engaged with shaft 90. At the distal end of shaft 90 the cutting means which are preferably in the form of pneumatic scissors 92 are attached.

Upon actuation of ram 84, movement of piston rod 86 causes linkage 88 to pivot to in turn pivot scissors 92 from a first position out of engagement with the course former to a second position in engagement with the course former 14. Once in the second position, the scissors can be actuated to cut the pile fibre free from the former.

In the particularly preferred embodiment shown in FIG. 4, the carriage is further provided with means for altering the height at which the cutting means is engageable with the pile fibre wound about the course former. As shown, the height altering means comprises a ram 94, the piston rod of which is operatively engageable with the top of shaft 90. The actuation of ram 94 causes shaft 90 and scissors 92 attached thereto to be moved downwards or upwards a small distance, conveniently about 3 mm. The cutting means is movable up and down in this way in order to ensure that the length of the pile fibre cut free from the course former 14 remains substantially the same irrespective of the direction from which the pile fibre has been wound about the former.

The apparatus according to the invention further includes backing sheet feed means to feed the backing sheet into a position where the pile fibre wound about the course former to which the adhesive has been applied can be contacted with the backing sheet. The backing sheet, which can be any suitable type of material, for example a cotton material is suitably provided in the form of a roll of material.

Figure 5:
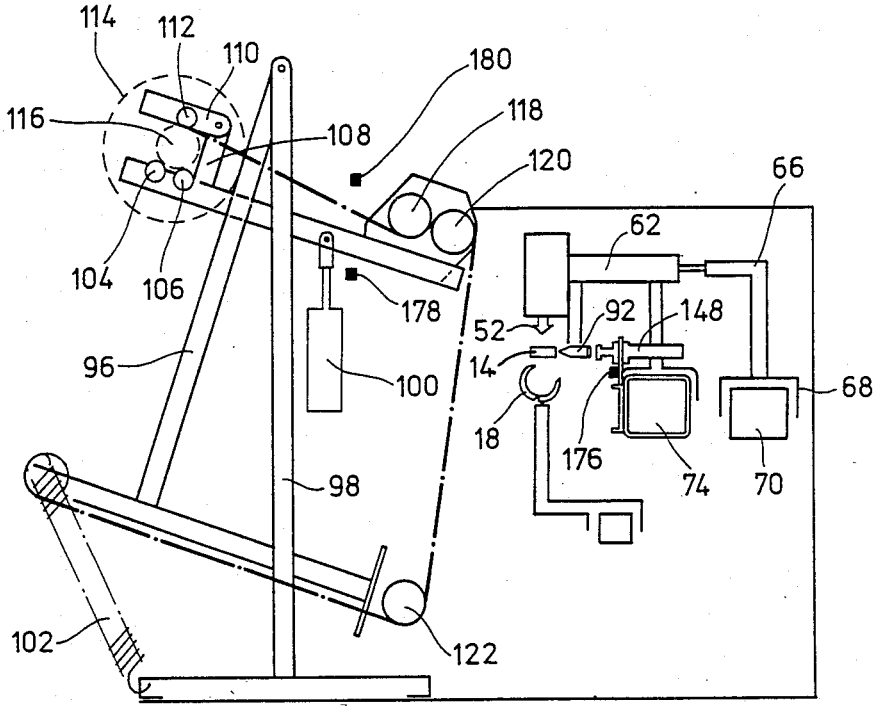
FIG. 5 is a side elevational view of the preferred backing sheet feed means according to the invention.

The presently preferred construction of the backing sheet feed means of the invention is shown in FIG. 5 of the accompanying drawings. As illustrated, the backing sheet feed means includes a frame 96 having a plurality of rollers mounted thereon. The frame 96 is preferably pivotally mounted to the frame 12 of the apparatus on upstanding post 98 to allow it to be tilted upwards and forwards during operation. The present method of achieving this tilting action is by the use of a ram 100, preferably a pneumatic ram, which is mounted to frame 12 of the apparatus. Of course, many other arrangements could also be used to achieve the desired tilting action.

In the embodiment shown in FIG. 5, it is further preferred that the backing sheet feed means be biased towards a position where the backing sheet is out of contact with the course former 14. To this end, the backing sheet feed means is provided with biassing means which urge the frame 96 back to a rest position. Conveniently, as is shown in FIG. 5 the biassing means may be in the form of a spring 102 although this is not critical.

The backing sheet feed means incorporates first mounting means which conveniently includes roller bearings 104 and 106 mounted to the frame 96. Also mounted to frame 96 adjacent roller bearing 106 is a bar 108 to which an arm 110 is pivotally mounted. Arm 110 is provided with roller bearing 112 and is pivotable into a position spaced apart but substantially parallel with the section of frame 96 to which roller bearing 104 and 106 are mounted. In this way, a roll of material 114 wound about a roller 116 can be positioned between the roller bearings 104, 106 and 112 to be capable of freely rotating on the bearings.

In this embodiment, it is further preferred that means be provided to lock arm 110 in position when a roll of material is in position.

It will be appreciated that a similar construction of first mounting means is provided in a corresponding position at the other end of the backing sheet feed means to allow a roll of material 114 to be releasably and rotatably mounted on the frame 96.

The backing sheet feed means further includes drive roller means. As shown, when a roll of material 114 is mounted to the first rolling means, the free end of the material extends across the top of the frame 96 to the drive roller means. As illustrated, the drive roller means is conveniently in the form of a pair of feed rollers 118 and 120. The backing sheet material passes beneath feed roller 118 and over feed roller 120. Feed roller 120 is indexed to unwind a predetermined length of the backing sheet from the roll of backing sheet 114 mounted to the first mounting means. The length of backing sheet which the feed roller 120 is indexed to unwind from the roll corresponds to the spacing between the courses of pile fibre which are to be repeatedly adhered to the backing sheet in the formation of the pile fabric.

The indexed feed roller 120 may be driven by any suitable drive means such as an electric motor. It is further preferred that feed roller 120 be provided with a gripping surface to grip the backing sheet in order to ensure that the same length of material is repeatedly unwound from the roll.

In the presently preferred embodiment, the frame 96 of the backing sheet feed means also has a drop roller 122 mounted thereto. When a roll of material is mounted to the first mounting means, the backing sheet material extends downwardly from feed roller 20 past course former 14 to engage drop roller 122.

Drop roller 122 is preferably pivotally mounted to frame 96 by arm 124, (See FIG. 6A) the pivoting movement of drop roller 122 being controlled by the tension of the backing sheet with which it is engaged.

The frame 96 of the backing sheet feed means further includes second mounting means at one end thereof by which an uptake roller can be releasably and rotatably mounted to the frame. The second mounting means is associated with drive means for driving the uptake roller when mounted to the second mounting means to take up the backing sheet to which the pile fibre has been adhered.

Figure 6A:
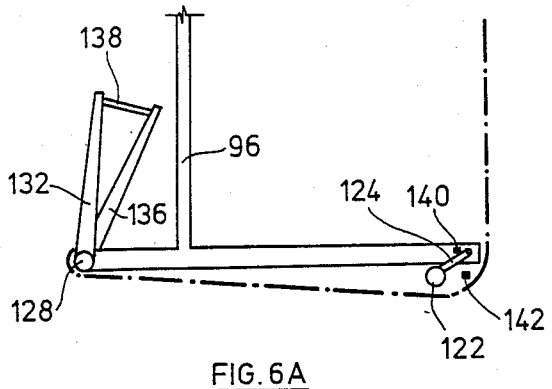
FIG. 6A is a side elevational view of the take-up roller mounting of the invention.
Figure 6B:
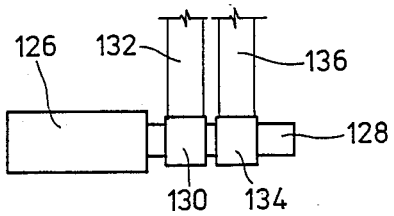
FIG. 6B is a front elevational view of the mounting of FIG. 6A.

The preferred construction for both the second mounting means and the drive means associated therewith is shown in FIGS. 6A and FIGS. 6B. In this preferred construction the uptake roller when mounted to the second mounting means is capable of rotating in one direction only to take up the backing sheet to which the pile fibre has been adhered and the drive means is co-operable with first and second sensing means such that the drive means is actuated to drive the uptake roller to take up the backing sheet upon actuation of the first sensing means and remains actuated until the second sensing means is actuated.

As is shown in FIG. 6B, the second mounting means includes means 126 for engaging with the uptake roller to rotate with the roller and further includes a shaft 128. To shaft 128 there is mounted a first sprag clutch 130 of the drive means which has a first lever 132 mounted thereto. Lever 132 is fixed in a substantially vertical position, preferably by attachment via a pin to frame 96. On shaft 128 there is also provided a second sprag clutch 134 positioned immediately adjacent the first sprag clutch 130, the second sprag clutch 134 having a second lever 136 mounted thereto. The first and second sprag clutches are mounted upon shaft 128 so as to be rotatable in the same direction about the shaft.

As is shown in FIG. 6A, the drive means associated with the second mounting means also includes means capable of moving the distal end of one of the levers, preferably of second lever 136, from a spaced apart position towards the distal end of the other lever, preferably lever 132. Conveniently, the moving means is in the form of a pneumatic ram 138. In this way, when ram 138 causes lever 136 to move towards lever 132, the shaft 128 is rotatable only in the direction of movement of lever 136 towards lever 132 but is incapable of rotating in the opposite direction due to the provision of the sprag clutches.

The sensing means with which the drive means described above is co-operable are preferably associated with drop roller 122. As shown in FIG. 6A, first sensing means which may be in the form of a pressure or contact sensor 140 is positioned such that when the backing sheet is taut around drop roller 122, the pivotable arm 124 on which the roller 122 is mounted is in contact with the sensor 140. The sensor 140 comprises the stop sensor for the drive means described above.

There is also provided a second sensing means preferably again in the form of a contact sensor 142 which is positioned such that the arm 124 on which drop roller 122 is mounted comes into contact with sensor 144 when roller 122 drops to keep an appropriate tension on the backing sheet material during the unwinding of a predetermined length of material from the roll of material mounted to the first mounting means by feed roller 120. Accordingly, when a new length of material is unwound by feed roller 120, drop roller 122 pivots downwardly in engagement with the backing sheet material to cause the arm 124 to move from its position in contact with the first sensor 140 to a position in contact with the second sensor 142. The second sensor 142 comprises a go sensor which causes the drive means to be actuated to rotate the shaft 128 of the engaging means such that the backing sheet to which the pile fibre has been adhered is wound about an uptake roller engaged with the engaging means.

It will be appreciated by those persons skilled in the art that when a fresh uptake roller is engaged with the engaging means 126, more rotational movement of the shaft 128 will be required to take up the preset length of material than will be the case when an amount of backing sheet material is already wound about the uptake roller. Accordingly, the degree of rotational movement of shaft 128 to take up the same length of backing sheet will progressively decrease due to the increasing diameter of the roll of pile fabric.

For the above reason, when a fresh uptake roller is mounted in engagement with the engaging means 126, it is likely that more than one working stroke of ram 138 will be required to wind the preset length of material about the uptake roller. Accordingly, in particularly preferred embodiments there is provided a third sensing means (not shown) associated with the first lever 132 such that if the ram 138 completes its full working stroke before the arm 124 contacts first sensor 140, the third sensing means actuates a second working stroke of ram 138. Thus, a sequence of continued actuation of the drive means is maintained until the stop sensor 140 is contacted by arm 124 in order to indicate that the required length of material has been wound about the uptake roller.

In preferred embodiments of the invention, the apparatus also includes abutment means being positionable in contact with the side of the backing sheet opposite to that to which the pile fibre wound about the course former is to be adhesively engaged. The abutment means of this embodiment is at substantially the same height as the course former. In this way, the backing sheet is retained in continuous engagement with the pile fibre wound about the course former and the abutment means provides a firm surface against which the appropriate adhesive bond can be formed.

Figure 7:
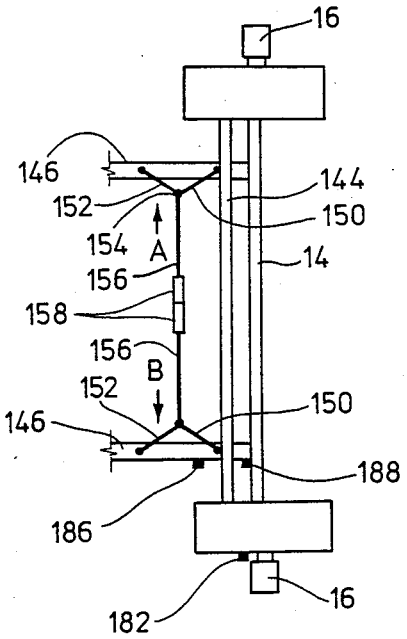
FIG. 7 is a plan view showing the construction of the preferred abutment means of the invention.

The presently preferred construction for the abutment means of the apparatus is shown in FIG. 7. As illustrated, the abutment means preferably comprises a metal batten 144 of substantially similar construction to course former 14. The batten 144 is mounted upon tracks 146 and is slidably movable therealong under the influence of abutment drive means.

In the presently preferred construction, the abutment drive means includes first and second linkages 150 and 152 which are pivotally connected to form an elbow joint 154. The end of linkage 150 remote from elbow joint 154 is attached to batten 144, whereas the distal end of linkage 152 is secured in position on tracks 146. The two elbow joints 154 are joined together by linkage rods 156 operatively associated with longitudinal drive means, preferably in the form of pneumatic rams 158.

Accordingly, in operation, the actuation of rams 158 causes the linkage rods 156 to be moved in the direction of arrows A and B respectively. This movement of linkage rods 156 causes elbow joints 154 to pivot towards a position where linkages 150 and 152 are in alignment, thus causing the batten 144 to slide along tracks 146 and to engage with the backing sheet material.

In particularly preferred embodiments, the abutment means includes heating means capable of heating the area of the backing sheet with which it is in contact in order to at least partially cure the adhesive bond between the pile fibre and the backing sheet in that area.

Where the apparatus includes abutment means as above, it is also preferred that there be provided means engageable with the course former when the course former is positioned to adhesively contact the pile fibre with the backing sheet to both support the course former in a substantially horizontal position and to press the pile fibre wound about the course former firmly into contact with the backing sheet. For example, means to press the course former into contact with the backing sheet in the form of pneumatic rams 148 are shown in FIG. 5. The means to maintain the course former in a substantially horizontal position, although not shown in the accompanying drawings, can also include a pneumatic ram provided with an appropriate linkage arrangement designed to position a bar beneath the and in contact with the course former at substantially the same time as rams 148 engage the course former to press it into contact with the backing sheet.

In further preferred aspects of the invention, the apparatus is provided with means capable of engaging with the pile fabric formed by the adhesion of a plurality of courses of pile fibre to the backing sheet to remove from the pile fabric the pile fibre which has not firmly adhered to the backing sheet. Although any such means which firstly agitate the pile fibre attached to the backing sheet and then remove any loosened pile fibre from the pile fabric may be used the presently preferred construction of the fibre removal means is shown in the accompanying drawings.

Figure 8:
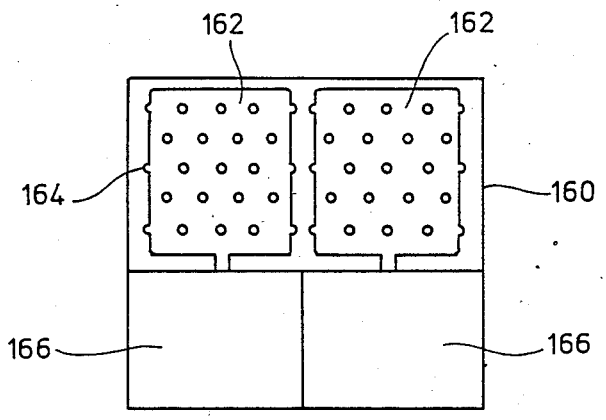
FIG. 8 is a front elevational view of the preferred fibre removing means of the invention.

In particular, as is shown in FIG. 8, the means comprises a housing 160 within which are provided a pair of rotatable drums 162 having a plurality of fibre engaging projections 164 on their outer surface. Each of drums 162 is provided with its own electric motor 166 to rotatably drive the drum. Conveniently, the drums are rotatably driven in opposite directions such that the pile fibre when engaged by the projections 164 on separate drums is agitated in opposite directions. This is preferred to avoid the problem of the pile fibre being caught between the drums 162.

It will be appreciated that the shape shown for the fibre engaging projections 164 is not critical and that any shape and distribution of the projections can be used to perform the agitating function. However, it will also be appreciated that the shape of the projections 164 should not be such that the pile fibre is hooked or otherwise caught by the projections and ripped free from the backing sheet.

Although in the preferred construction of the fibre removing means two drums are shown, it will be apparent that a single drum only could be used.

In the particularly preferred form of this embodiment, the drums 162 are associated with a source of negative pressure such that the pile fibre removed by the agitation the drums 162 is sucked into the housing and away from the general area of the apparatus. It will be appreciated that the removal of the pile fibre is preferred to leave the working components of the apparatus as free as possible from unbound fibre.

It is further preferred that the fibre removal means be associated with a longitudinal drive and driven on a track from one side of the pile fabric to the other. The fibre removal means may be provided with its own longitudinal drive or may be driven off the same longitudinal drive as the carriage 72 carrying both the adhesive applicator and the cutting means. This preferred arrangement is illustrated in FIG. 1. where the pile fibre removal means is mounted to a track 161 and driven by drive chain 82.

The apparatus of the invention may optionally also include further heating means to cure the adhesive bond between the pile fibre and the backing sheet. Such heating means is additional to the heated surfaces provided by both the course former 14 and the batten 144 2nd can be located in the apparatus between the point at which the pile fibre is adhered to the backing sheet and the point at which the fibre removal means is agitatively engaged with the pile fabric. Although not shown, such heating means preferably consists in a single element extending from one side of the apparatus to the other.

Conveniently, the apparatus further includes control means to control the operation of the apparatus in a preset sequence. As is schematically represented in FIG. 1, the control means labeled PLC is coupled to the various position sensors and solenoids, motors, etc., in the apparatus (as will be described below). The control means is preferably a programmable logic controller (PLC) which may, for example, be the SAIA PCA14. The PLC, which is programmed in a manner which will be apparent to those skilled in the art, receives positions signals from the sensors referred to below and in response thereto energizes solenoids, motors, etc., to cause the apparatus to operate in the sequence described below.

The PLC is associated with various sensors such as magnetic sensors and with various switches such as limit switches which are appropriately arranged on the apparatus to provide input information as to the positioning of the components of the apparatus.

In the present arrangement, 10 sensors and/or switches are provided. The disposition of these switches is as shown in the accompanying drawings.

As shown in FIG. 1, there are provided two limit switches 170 and 172 associated with track 161 to which the pile fibre removal means is mounted. These sensors indicate when the pile fibre removing means has travelled the full distance from one side of the apparatus to the other. In addition, where drive chain 82 is arranged to drive both carriage 72 and the pile fibre removing means, the switches 170 and 172 also indicate when carriage 71 has completed its travel from one side of the apparatus to the other.

As is also shown in FIG. 1, a sensor in the form of a limit switch 174 is provided on track 19 for the pile fibre feed means 18. Switch 174 sets the position at which the winding of pile fibre commences for one course and the position at which the winding terminates for the next course.

As can be seen from FIG. 5, there is provided a sensor, which is preferably a proximity sensor 176, in association with one of rams 148 to indicate when the rams 148 have reached their rest position out of engagement with course former 14. FIG. 5 also shows sensors 178 and 180 which co-operate with ram 100. Sensor 178 indicates when ram 100 and hence frame 96 are positioned for engagement of the backing sheet with the pile fibre wound about the course former 14.

FIG. 7 of the accompanying drawing shows the provision of sensor 186 and 188 on tracks 146 of the abutment means. Sensor 186 indicates when batten 144 is in its rest position out of engagement with the backing sheet while sensor 188 indicates when batten 144 is in working engagement with the backing sheet to ensure appropriate adhesive contact occurs between the backing sheet and the pile fibre wound about the course former 14.

Finally, two proximity sensors 182 and 184 are provided on frame 12 in the positions illustrated in FIGS. 1 and 7. Sensor 182 indicates when the former 14 has been horizontally positioned with the adhesive contact surface towards the backing sheet and sensor 184 indicates when the former 14 is in a vertical position with the adhesive contact surface facing upwards.

The function of the above sensors and switches is described in more detail below.

On the basis of the input information provided the PLC activates the various functions of the components of the apparatus by outputting to contactors and solenoids associated therewith. The solenoids cooperate with a pneumatic system which includes a compressor to operate electrovalves 26', 47', 76', 84', 94', 100', 148', and 158' (not shown) with rams 26, 47, 76, 84, 94, 100, 148 and 158 respectively to activate the rams as required during the sequence of operations. The PLC also outputs to the stepper motors 16 and to the drive means for feed roller 120 to activate the motors as required and to the various heating means provided to cure the adhesive bond.

In a second aspect, the present invention consists in a method of manufacturing pile fabric. An example of the method of the invention using the preferred apparatus including a control means will now be described in particular details.

All solenoids associated with the control means are deactivated and the machine started. The rams 148 and the batten 144 are checked by sensors 176 and 186 to ensure that they are in their rest positions otherwise an error is indicated and the sequence is stopped. The course former 14 is set to a horizontal position by stepper motor 16 and the fibre removal means and the carriage 72 moved to their rest positions on the right hand side and left hand side of the apparatus respectively and their position checked by limit switch 170. Further, the pile fibre feed means 18 is moved to its rest position on the right hand side of the apparatus.

Once the apparatus is correctly positioned, the solenoid controlling the pile fibre feed means 18 is activated causing the jaws 20 and 22 to be raised by ram 26 to encircle the course former 14 and the course former is set rotating at a slow speed by stepper motors 16. The free end of the pile fibre which passes through opening 32 in jaw 20 is thus engaged with course former 14.

After approximately 1.5 turns of the course former at this slow speed, the solenoid controlling the pile fibre feed means 18 is deactivated, causing ram 26 to drop the feed means down below the course former 14. The course former 14 is then sped up to its selected speed by stepper motors 16 and chain 34 is also driven at its selected speed in the desired direction to wind the pile fibre being fed through opening 32 in jaw 20 along the length of course former 14 from its start position as sensed by switch 174.

Once the pile fibre feed means 18 has travelled the desired distance, corresponding to the selected width of the pile fabric, the drive chain 34 is disengaged and the course former 14 itself stopped in a vertical position with the adhesive contact surface upwards. This position is sensed by sensor 184.

This stopping of drive chain 34 ensures that during the formation of the next course the winding of the pile fibre about the former commences at the same position as the previous course terminated. In the next course, once winding has commenced, the pile fibre feed means is driven by chain 34 until it reaches the start position of the previous course as indicated by switch 174.

The carriage 72 is then driven by engagement of piston rod 80 of ram 76 with chain 82 from its rest position on the left hand side towards the right hand side of the apparatus. The drive chain 82 also causes the pile fibre removal means to be driven from its rest position on the right hand side as sensed by switch 172 to the left hand side of the apparatus where it contacts limit switch 170. The movement of the carriage 72 causes the piston rod 64 of cylinder 62 to displace diagram 56 of the constant displacement pump, in turn causing the adhesive to be displaced from the reservoir 38. The valve 46 is positioned by ram 47 such that the adhesive is displaced towards the supply until such time as the carriage 72 has reached the position where the pile fibre wound about the course former 14 commences. At this time, the adhesive solenoid is activated to cause valve 46 to be rotated via ram 47 to allow adhesive to be dispensed through nozzle 52 and onto the pile fibre wound about the course former 14 at a substantially constant rate.

Similarly, when carriage 72 reaches the point at which the pile fibre wound about the course former 14 terminates, the valve 46 is again adjusted by ram 47 due to the deactivation of the adhesive solenoid to cause the adhesive displaced from the reservoir 38 to move towards the supply and not out of the nozzle 52.

The carriage 72 remains in engagement with the drive chain 82 until its stop position on the right hand side of the apparatus is reached. This stop position is sensed by the activation of limit switch 170 by the pile fibre removal means also on drive chain 82. Piston rod 80 of ram 76 is then disengaged from chain 82. The course former 14 is then rotated through 90° into a substantially horizontal position as sensed by sensor 182 with the pile fibre to which the adhesive has been applied facing towards the backing sheet. The solenoid which controls the movement of ram 100 is then activated to cause the frame 96 of the backing sheet feed means to be tilted upwards and forwards from its rest position as sensed by sensor 178 until the backing sheet is in the appropriate position for adhesive contact as sensed by sensor 180. When this appropriate position is reached, the solenoid controlling the batten 144 is activated. The batten 144 is then slidably moved along tracks 146 by rams 158 from its rest position as sensed by sensor 186 until it engages with the backing sheet in its working position as sensed by sensor 188 and in turn causes the backing sheet to engage with the pile fibre to which the adhesive has been applied.

Once the batten 144 is in its working position, the solenoid controlling the rams 148 is actuated, causing the rams to engage with the cutting surface of the course former 14 to firmly press the course former and the pile fibre wound thereabout into adhesive engagement with the backing sheet.

At this time, the drive chain 82 for the pile fibre removal means and carriage 72 is reversed to drive the pile fibre removal means from its position on the left hand side of the apparatus as sensed by switch 170 to the right hand side of the apparatus until it contacts switch 172. Drive chain 82 is again reversed and the pile fibre removal means driven from the right hand side of the apparatus to the left hand side.

Once a sufficient period of time has passed to allow the adhesive bond to form between the pile fibre wound about the course former 14 and the backing sheet, the solenoid controlling the rams 148 is deactivated causing the rams to be retracted from engagement with the cutting surface of the course former. Once the rams 148 are sensed by sensor 176 to be in their rest position, the solenoid controlling the scissors 92 is activated to pivot the scissors from their rest position into engagement with the cutting surface of course former 14. The carriage 72 is re-engaged with drive chain 82 as before and both the carriage 72 and the pile fibre removal means driven from one side to the other side of the apparatus with the scissors 92 operating to cut the pile fibre free from the course former 14. During this travel, reservoir 38 is refilled with adhesive. Once the carriage 72 has reached the left hand side of the apparatus as sensed by contact of the pile fibre removal means with switch 174, the solenoid controlling the scissor 92 is deactivated, causing the scissors 92 to be pivoted away from engagement with the course former 14 and back into their rest position. The carriage 72 remains in engagement with drive chain 82, and the drive is stopped.

The solenoid controlling the batten 144 is then deactivated causing the batten 144 to be retracted from its position in engagement with the backing sheet to its rest position out of engagement with the backing sheet. Once the batten 144 is sensed to be in its rest position by a sensor 186, the solenoid controlling the ram 100 is deactivated and the frame 96 returns to its rest position under the influence of spring 102.

When ram 100 is sensed by sensor 178 to be in its rest position, the backing sheet is then unwound from the roll of material mounted to the first mounting means by a length corresponding to the spacing between adjacent rows of pile fibre by the feed roller 120. Once the appropriate length of material has been unwound, the cycle counter of the PLC is advanced by one. The number on the counter is compared with the required number of courses to be adhered to the backing sheet and if this number has been reached, a suitable number of unwinding steps are performed by feed roller 120 to set a gap for the following pile fabric which is to be produced.

Once the apparatus is again in the correct position for commencing the formation of the next pile fabric, the solenoid controlling the pile fibre feed means 18 is activated and the sequence of steps repeated.

In particularly preferred embodiments of the invention, the pile fibre comprises a continuous length of woolen sliver. In this way, pile fabrics incorporating the unique natural properties of wool can be produced.

Thus, in accordance with the present invention there is provided both a method and apparatus for producing pile fabrics which overcomes a number of the disadvantages with previous methods and apparatus. In particular, the apparatus is capable of producing pile fabrics of high quality with a minimum of operator involvement. This results in reduced labor costs and also in the capacity for operating continuously.

It will be appreciated by those persons skilled in the art that the above description is provided by way of example only and that the scope of the invention is limited only by the appended claims.

What is claimed is:

1. Apparatus for producing pile fabric comprising:

a frame;

feed means for feeding a continuous length of pile fibre;

a course former rotatably mounted within said frame and about which pile fibre from said pile fibre feed means can be wound;

drive means for rotating said course former;

an adhesive applicator carried by said frame for applying adhesive to said pile fibre when wound about said course former;

backing sheet feed means for feeding a backing sheet; and means for contacting the pile fibre about said course former and the backing sheet one with the other after application of the adhesive to the pile fibre;

means carried by said frame for cutting said pile fibre wound about said course former free from said former, the apparatus being such that in use a length of pile fibre from said pile fibre means is wound about said course former and has adhesive applied thereto before being contacted with the backing sheet from said backing sheet feed means for bonding with the backing sheet, the wound pile fibre then being cut free of the course former by the cutting means to leave a course of pile fibre adhesively bonded to the backing sheet.

2. Apparatus according to claim 1 wherein the adhesive is a curable adhesive, said apparatus further including one or more heating means to cure the adhesive bond between the pile fibre and the backing sheet.

3. Apparatus according to claim 1 wherein the pile fibre feed means includes means for at least partially encircling the course former such that in use a free end of the continuous length of pile fibre is engaged with the course former to be wound thereabout on rotation of the former.

4. Apparatus according to claim 3 wherein said encircling means is movable from a first position at least partially encircling the course former to a second position spaced apart from and below the course former once the winding of the pile fibre about the former has commenced to allow the former to be freely rotated to wind pile fibre fed from said pile fibre feed means along the length thereof, and means for moving said encircling means between said first and second positions.

5. Apparatus according to claim 3 wherein said encircling means includes a pair of concave jaw members, at least one of said jaw members being pivotable towards and away from the other of said jaw member.

6. Apparatus according to claim 1 including a track disposed substantially parallel to said course former, said pile fibre feed means being carried by said track for movement therealong and drive means for moving said pile fibre feed means along said track to feed pile fibre to the course former over the whole or part length thereof.

7. Apparatus according to claim 1 wherein said course former comprises a substantially rectangular batten having two pairs of opposed surfaces, one said pair of surfaces being of a width narrower than the width of the other of said pair of surfaces, the narrower pair of surfaces of said batten comprising respectively an adhesive contact surface and a cutting surface, the width of the other pair of opposed surfaces of the batten substantially corresponding to a length of the pile fibre to be applied to the backing sheet.

8. Apparatus according to claim 7 wherein the adhesive contact surface of the course former includes heating means.

9. Apparatus according to claim 7 wherein the cutting surface of the course former is provided with a longitudinal groove along the length thereof.

10. Apparatus according to claim 1 wherein the drive means comprises one or more stepper motors.

11. Apparatus according to claim 1 wherein the drive means comprises a psir of stepper motors one member of said pair being provided at each end of the course former.

12. Apparatus according to claim 1 including a carriage, said adhesive applicator being mounted on said carriage, a longitudinal drive engageable with said carriage to move said applicator over the length of the course former about which the pile fibre is to be wound, the applicator including a constant displacement pump connected to a nozzle to apply adhesive to the pile fibre when wound about the course former.

13. Apparatus according to claim 12 wherein the constant displacement pump includes:

a body having an interior and an exterior, the interior of the body incorporating a reservoir capable of containing adhesive within its volume, said reservoir having an opening to the exterior of the body;

diaphragm means covering the opening of the reservoir and resiliently movable to vary the volume of the reservoir;

valving means connectable to an adhesive supply, said valving means being adapted to selectively pass adhesive from said supply to the reservoir, pass adhesive from the reservoir to the supply and pass adhesive from said reservoir to said nozzle; and means for displacing the diaphragm means at a constant rate to constantly reduce the volume of the reservoir;

the apparatus being such that when the reservoir is filled with adhesive from said supply and the diaphragm means is displaced at a constant rate by the displacement means, adhesive is caused to be dispensed from the nozzle onto the pile fibre wound about the course former at a substantially constant rate.

14. Apparatus according to claim 12 wherein the cutting means is also mounted to said carriage, the carriage including means for pivoting said cutting means from a first position out of engagement with the course former to a second position at an appropriate height to engage with the course former to enable the cutting means to cut the pile fibre wound about the course former free from said former.

15. Apparatus according to claim 14 wherein said carriage further includes means for altering the height at which the cutting means is engageable with the pile fibre when wound about the course former such that the pile fibre cut free from the former remains substantially the same length irrespective of direction from which the pile fibre has been wound about the former.

16. Apparatus according to claim 1 wherein the backing sheet feed means includes:

a frame;

first mounting means by which a roll of backing sheet to which the pile fibre is to be adhered can be releasably and rotatably mounted to the frame;

second mounting means by which an uptake roller can be releasably and rotatably mounted to the frame;

drive means for driving the uptake roller to take up the backing sheet to which the pile fibre has been adhered; and drive roller means for unwinding a predetermined length of backing sheet from a roll of backing sheet mounted to said first mounting means;

the apparatus being such that in use when a roll of backing sheet is mounted to the first mounting means and an uptake roller is mounted to the second mounting means, a free end of the backing sheet passes from said roll around said drive roller means and is attached to the uptake roller to be wound thereabout and said predetermined lengths of backing sheet are repeatedly unwound from the roll by the indexed drive roller means.

17. Apparatus according to claim 16 wherein the frame for the backing feed sheet is pivotally mounted, said feed means further including tilting means to tilt the frame from a first position where the backing sheet is out of contact with the course former to a second position where the backing sheet is in adhesive contact with pile fibre wound about the course former to which the adhesive has been applied.

18. Apparatus according to claim 17 including means for biasing the frame for the backing sheet feed means towards said first position out of contact with the course former.

19. Apparatus according to claim 16 wherein the uptake roller when mounted to the second mounting means is capable of rotating in one direction only to take up the backing sheet to which the pile fibre has been adhered, and the drive means for the uptake roller is co-operable with first and second sensing means such that the drive means is actuated to drive the uptake roller to take up the backing sheet upon actuation of the first sensing means and remains actuated until the second sensing means is actuated.

20. Apparatus according to claim 19 wherein the backing sheet feed means includes a drop roller which engages with the backing sheet in use to apply a tension thereto, said drop roller being pivotally mounted to the frame of the backing sheet feed means for movement from a first position in contact with said first sensing means to a second position in contact with said second sensing means, the pivoting of the drop roller from the first position to the second position being controlled by the tension of the backing sheet with which the drop roller is engaged.

21. Apparatus according to claim 16 wherein the second mounting means includes means for engaging said uptake roller to rotate therewith, said engaging means including a shaft, and the drive means for the uptake roller includes:

a first sprag clutch mounted to the shaft having a first lever mounted thereto, said first lever having a distal end which is fixed to said frame in a substantially vertical position;

a second sprag clutch mounted to the shaft immediately adjacent the first sprag clutch, the second sprag clutch having a second lever mounted thereto, which lever has a distal end remote from the second sprag clutch, said first and second sprag clutches both being rotatable in a single direction about the shaft; and means capable of moving the distal end of the second lever from a position spaced apart from the first lever in a direction towards the distal end of the first lever such that the shaft is capable of rotating in the direction of movement of the second lever towards the first lever but is incapable of rotating in the opposite direction.

22. Apparatus according to claim 21 wherein said lever moving means comprises a pneumatic ram.

23. Apparatus according to claim 1 further including means capable of engaging with the pile fabric formed by adhesion of a plurality of courses of pile fibre to the backing sheet to remove from the pile fabric the pile fibre which has not firmly adhered to the backing sheet.

24. Apparatus according to claim 23 wherein the fibre removing means includes at least one rotatable drum having a plurality of fibre engaging projections from an outer surface thereof.

25. Apparatus according to claim 24 wherein the fibre removing means includes two said drums rotatable on parallel axes, said drums being contrarotatable.

26. Apparatus according to claim 1 further including abutment means being positionable in contact with a side of the backing sheet opposite to that which the pile fibre wound about the course former is to be adhesively engaged, said abutment means being at a substantially equivalent height to the course former to retain the backing sheet in continuous engagement with said pile fibre during the adhesive contacting of the pile fibre with the backing sheet.

27. Apparatus according to claim 26 wherein the abutment means is mounted to a track and slidably movable therealong by abutment drive means from a position out of contact with the backing sheet to a position in contact with the backing sheet.

28. Apparatus according to claim 26 wherein the abutment means includes heating means capable of heating an area of the backing sheet with which it is in contact such that adhesive bonding between the pile fibre and the backing sheet in that area of the backing sheet is at least partially cured.

29. Apparatus according to claim 1 further including means engageable with said course former when the course former is positioned to adhesively contact the pile fibre wound thereabout with the backing sheet, said means being capable of maintaining the course former in a substantially horizontal position.

30. Apparatus according to claim 1 further including means engageable with the course former to press the pile fibre when wound about the course former firmly into contact with the backing sheet.

31. Apparatus according to claim 1 further including control means to operate the apparatus in a preset sequence to produce a pile fabric comprising a plurality of courses of a pile fibre adhered to a backing sheet.

* * * * *